US005825334A

United States Patent [19]

Gherardini et al.

[11] Patent Number: 5,825,334

[45] Date of Patent: Oct. 20, 1998

[54] FLEXIBLE ANTENNA AND METHOD OF MANUFACTURING SAME

[75] Inventors: Stephen Daniel Gherardini, Harrisburg; Scott Keith Mickievicz, Denver; Richard Nicholas Whyne, Mechanicsburg; John Anthony Woratyla, Camp Hill, all of Pa.

[73] Assignee: The Whitaker Corporation, Wilmington, Del.

[21] Appl. No.: 689,418

[22] Filed: Aug. 9, 1996

[51] Int. Cl.[6] ..... H01Q 9/38

[52] U.S. Cl. ..... 343/830; 343/700 MS; 343/770; 343/795; 343/906

[58] Field of Search ..... 343/702, 700, 343/715, 900, 903, 906, 897, 790, 791, 770, 795, 806, 829, 830, 873, 895; H01Q 1/38

[56] References Cited

U.S. PATENT DOCUMENTS

| | | | |
|---|---|---|---|
| 1,774,538 | 12/1930 | Aegerter . | |
| 2,039,988 | 5/1936 | Graves | 343/897 |
| 2,611,868 | 9/1952 | Marston et al. | 343/830 |
| 4,260,988 | 4/1981 | Yanagisawa et al. | 343/700 MS |
| 4,356,492 | 10/1982 | Kaloi | 343/700 MS |
| 4,381,566 | 4/1983 | Kane | 455/193 |
| 4,438,437 | 3/1984 | Burgmyer | 343/770 |
| 4,475,107 | 10/1984 | Makimoto et al. | 343/700 MS |
| 4,611,213 | 9/1986 | Johnson et al. | 343/702 |
| 4,682,180 | 7/1987 | Gans | 343/769 |
| 4,725,395 | 2/1988 | Gasparaitis et al. | 264/250 |
| 4,761,823 | 8/1988 | Fier | 455/89 |
| 4,800,392 | 1/1989 | Garay et al. | 343/700 MS |
| 4,868,576 | 9/1989 | Johnson, Jr. | 343/702 |
| 4,987,424 | 1/1991 | Tamura et al. | 343/795 |
| 5,164,739 | 11/1992 | Koide et al. | 343/749 |
| 5,363,114 | 11/1994 | Shoemaker | 343/828 |
| 5,392,055 | 2/1995 | Madnick et al. | 343/790 |
| 5,563,615 | 10/1996 | Tay et al. | 343/749 |
| 5,608,415 | 3/1997 | Sugawara et al. | 343/830 |

FOREIGN PATENT DOCUMENTS

| | | | |
|---|---|---|---|
| 3129045 A1 | 10/1982 | Germany | H01Q 21/06 |
| 5110329 | 4/1993 | Japan | H01Q 9/26 |
| 682777 A5 | 11/1993 | Switzerland | H01B 12/02 |

OTHER PUBLICATIONS

*IEEE Transactions on Antennas and Propagation, vol. 42, No. 2, Feb. 1994* (pp. 260–264) "Superstrate Loading Effects on the Circular Polarization and Crosspolarization Characteristics of a Rectangular Microstrip Patch Antenna" Wen–Shyang.

*IEEE Transactions on Antennas and Propagation, vol. 42, No. 2, Feb. 1994* (pp. 129–136) "Broadband Microstrip Antenna Design with the Simplified Real Frequency Technique" Hongming An.

*IEEE Transactions on Applied Superconductivity, vol. 4, No. 1, Mar. 1994* (pp. 33–40) "On the Design and Performance of Electrically Small Printed Thick Film $YBa_2Cu_3O_{7-x}$ Antennas" L.P. Ivrissimtzis.

(List continued on next page.)

*Primary Examiner*—Hoanganh T. Le
*Assistant Examiner*—Tho Phan
*Attorney, Agent, or Firm*—Katherine A. Nelson

[57] ABSTRACT

An antenna (20) including a continuous planar conductor (22) in a coaxial connector. The planar conductor (22) is made by stamping an array of slots (30) in a continuous sheet of metal with ends of adjacent slots (30) being offset from each other in an alternating pattern of long and short slot portions (32, 36) on each side of a centerline of the array; at least filling each slot (30) with a dielectric material (50), thereby defining a slot filled strip; and cutting along each side of the slot-filled strip intersecting each filled long slot portion (32) at a sufficient distance from the ends of adjacent ones of the filled short slot portions (36) to define a strap (42) of metal connecting the metal strips on each side of each slot (30).

7 Claims, 12 Drawing Sheets

OTHER PUBLICATIONS

*IEEE Transactions on Antennas and Propagation, vol. 41, No. 10, Oct. 1993* (pp. 1371–1378) "Analysis and Design of Multilayer Printed Antennas: A Modular Approach" Naftali I. Herscovici.

*IEEE Transactions on Antennas and Propagation, vol. 42, No. 8, Aug. 1994* (pp. 1106–1113) "Performance Analysis of Antennas for Hand–Held Transceiver Using FDTD" Michael A. Jensen.

*IEEE Transactions on Antennas and Propagation, vol. 42, No. 4, Apr. 1994* (pp. 538–540) "A Design of AM/FM Mobile Telephone Triband Antenna" Shigeru Egashira.

FLEXIBLE ANTENNA AND METHOD OF MANUFACTURING SAME

This application claims the benefit of U.S. Provisional Application No. 60/002,159, filed Aug. 11, 1995.

FIELD OF THE INVENTION

This invention relates to antennas in general and in particular to a flexible antenna for use with portable devices such as telephones and the like.

BACKGROUND OF THE INVENTION

The use of helical antennas for flexibility is well known. Conventional helical antennas are constructed by winding a helical coil, attaching the coil to an antenna connector, and encasing the coil in a plastic sleeve. The coil is then trimmed to a desired electrical resonance and a cap or other device is inserted over the upper trimmed antenna. The disadvantage of this type of antenna is that it must be trimmed for the proper frequency resonance after construction.

U.S. Pat. No. 4,725,395 discloses a helical antenna that includes a helically formed wire coil having upper and lower ends and a substantially rigid, solid dielectric material included within the helical coil. The dielectric material maintains the dimensions of the coil and the helices thereby eliminating the necessity to trim the resulting antenna.

The manufacturers of portable telephones, radios and like are continually making electronic devices that are smaller in size. It is desirable, therefore, to have antennas having the desired electrical characteristics yet being more compact and more flexible than ones currently available. It is also desirable that the antennas be cost effective to manufacture.

SUMMARY OF THE INVENTION

The present invention is directed to alleviating problems associated with the prior art. The antenna of the present invention is a flat flexible antenna having a continuous planar conductor terminated to a coaxial connector. The planar conductor is manufactured by the steps of: stamping an array of slots having a selected length in a continuous sheet of metal such that the ends of the adjacent slots are offset from each other by a selected distance in an alternating pattern of long and short slot portions on each side of the center line of the array; at least filling each slot with a dielectric material having selected electrical characteristics thereby defining a slot-filled strip; and cutting along each side of the slot-filled strip intersecting each filled long slot portion at a sufficient distance from the ends of adjacent ones of the filled short slot portions to define a strap of metal connecting metal strips on each side of the corresponding short slot. Adjacent ones of the slots are separated by a strip of metal having a selected width. The straps have a width at least equal to the width of the metal strips between the adjacent filled slots, the remaining metal thereby defining a continuous planar conductor having a generally rectangular wave-like structure.

The invention is further directed to a method of manufacturing an antenna having the above planar conductor. The method includes stamping an array of slots as previously described; stamping a continuous conductor at one end of the slot array such that the first end of the conductor is in communication with one of the slot portions of the array and the second end is adapted to engage a lead of a contact; electrically and mechanically securing the contact lead to the end of the continuous conductor; and molding an insulating body from a dielectric material around the secured contact lead portion and a portion of the continuous conductor, and at least filling each slot with a dielectric material; the material further covering at least a portion at the first end of the array to form an insulating pad adapted to receive a ground conductor; cutting along each side of the slot-filled strip intersecting each filled long slot portion as previously described; disposing a ground conductor on the insulating pad and positioning a conductive shell over the secured lead and end of the planar conductor such that the conductive shell is engaged with the ground pad. In the preferred embodiments a resilient sleeve-like member or boot is positioned over the assembly.

The advantages of the present invention include that it is cost effective to manufacture. Multiple arrays of slots may be stamped in a metal sheet. The arrays of slots in the metal strip and the configuration of the conductor at one end thereof are such that the entire subassembly can be supported by placing the metal sheet in a mold for an insert molding process. The excess metal sheet can be removed after the molding process is completed. The insert-molding process permits the thickness of the dielectric layer disposed over the conductor to be precisely controlled.

Embodiments of the present invention will now be described by way of example with reference to the accompanying drawings.

BRIEF DESCRIPTIONS OF THE DRAWINGS

FIGS. 7 through 18 illustrate the steps in making one preferred embodiment of the present invention.

FIG. 7 is a top view of a metal sheet having a plurality of arrays of slots stamped therein.

FIG. 8 is an enlarged fragmentary portion of another section in FIG. 7 showing the details of the slots in the arrays.

FIG. 9 is an enlarged fragmentary portion of one of the slot arrays in FIG. 7 showing the continuous conductor at one end thereof.

FIG. 10 is a top view of the one array of FIG. 7 after the center conductor has been connected thereto and the structure has been over molded with dielectric material.

FIG. 11 is a top view of the filled planar conductor after the structure has been severed from the metal sheet.

FIG. 12 is a perspective view of the structure of FIG. 11.

FIG. 13 is a side view of the structure of FIG. 10 with the strip removed and illustrating the over molded dielectric material.

FIG. 14 is a cross-sectional view taken along line 14—14 of FIG. 11.

FIG. 15 is a cross-sectional view taken along line 15—15 of FIG. 11.

FIG. 16 is a cross-sectional view taken along line 16—16 of FIG. 11.

FIG. 17 is a cross-sectional view taken along line 17—17 of FIG. 11.

FIG. 18 is a cross-sectional view taken along line 18—18 of FIG. 11.

FIG. 19 is a top view of one array of slots stamped in a metal sheet with a second conductive member exploded therefrom.

FIG. 20 is an enlarged fragmentary portion of one of the slot arrays in FIG. 19 showing the continuous conductor at one end thereof and inner contact terminated thereto.

FIG. 21 is a top view of the one array of FIG. 19 after the center conductor has been connected thereto and the structure has been over molded with dielectric material.

FIG. 22 is a top view of the filled planar conductor of FIG. 19 after the structure has been severed from the metal sheet and having a ground conductor disposed thereon.

FIG. 23 is a side view of the structure of FIG. 22 with further parts of the assembly exploded therefrom.

FIG. 24 is a side view of the assembled alternative embodiment of FIG. 23.

FIG. 25 is a cross-sectional view taken along line 25—25 of FIG. 24.

FIG. 26 is a cross-sectional view of the assembly of FIG. 24 disposed in an insulating boot.

DETAILED DESCRIPTIONS OF THE DRAWINGS

Figure 3:
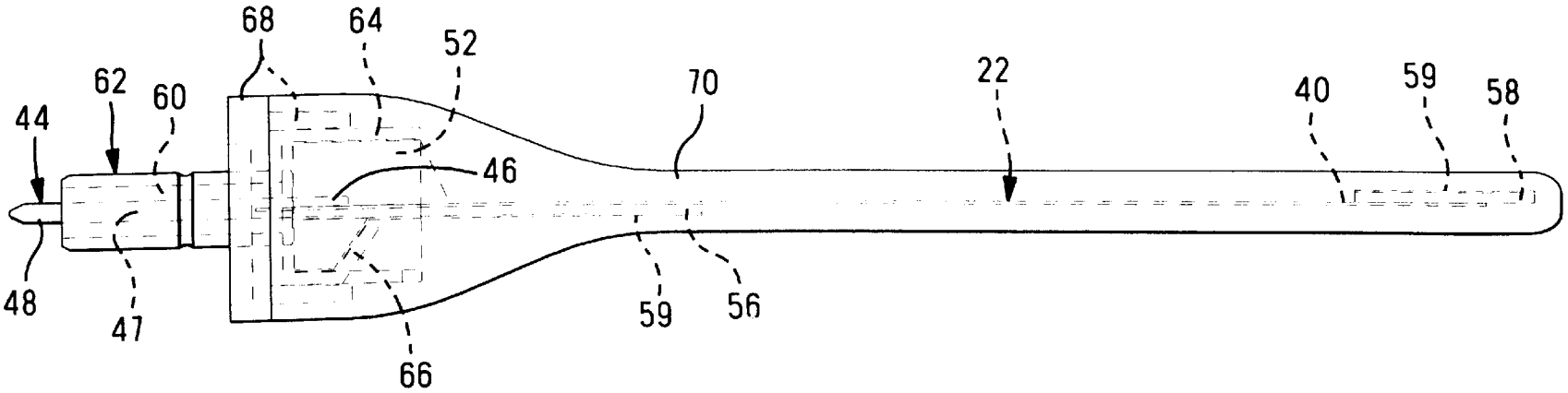
FIG. 3 is a side view of the antenna of FIG. 1 with the structure shown in phantom.
Figure 4:
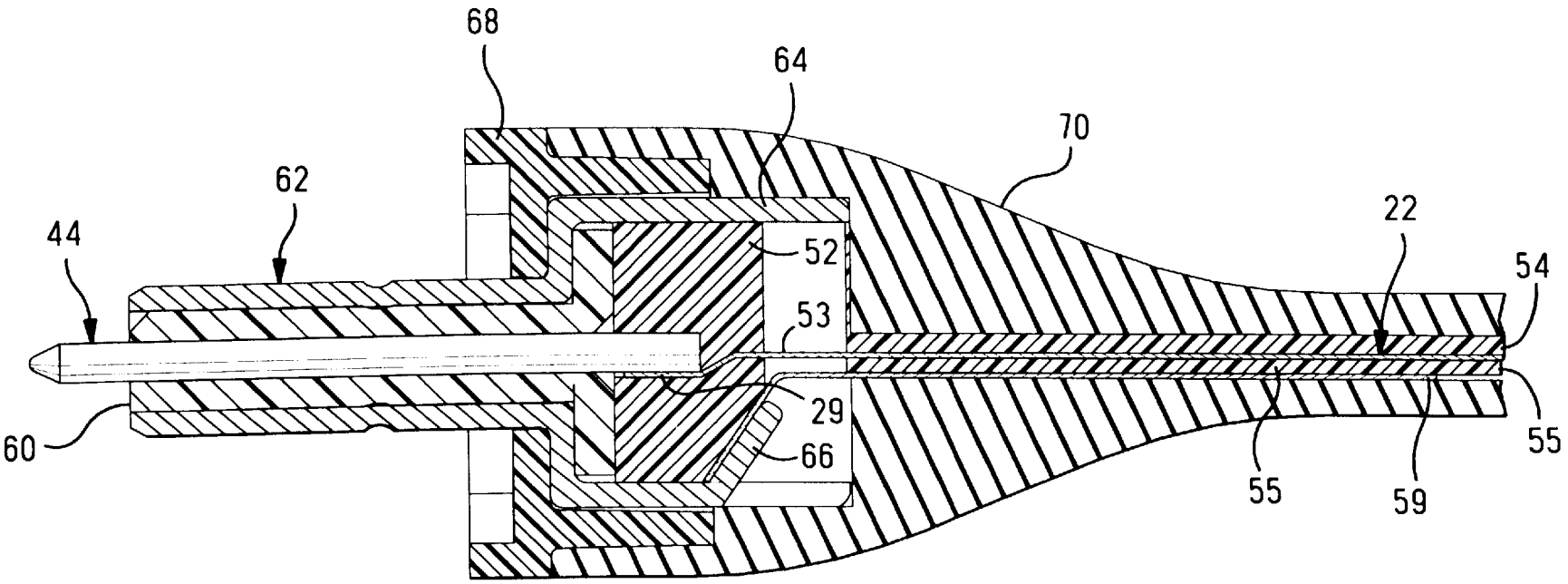
FIG. 4 is an enlarged fragmentary cross-sectional view of the connector portion of FIG. 3.
Figure 5:
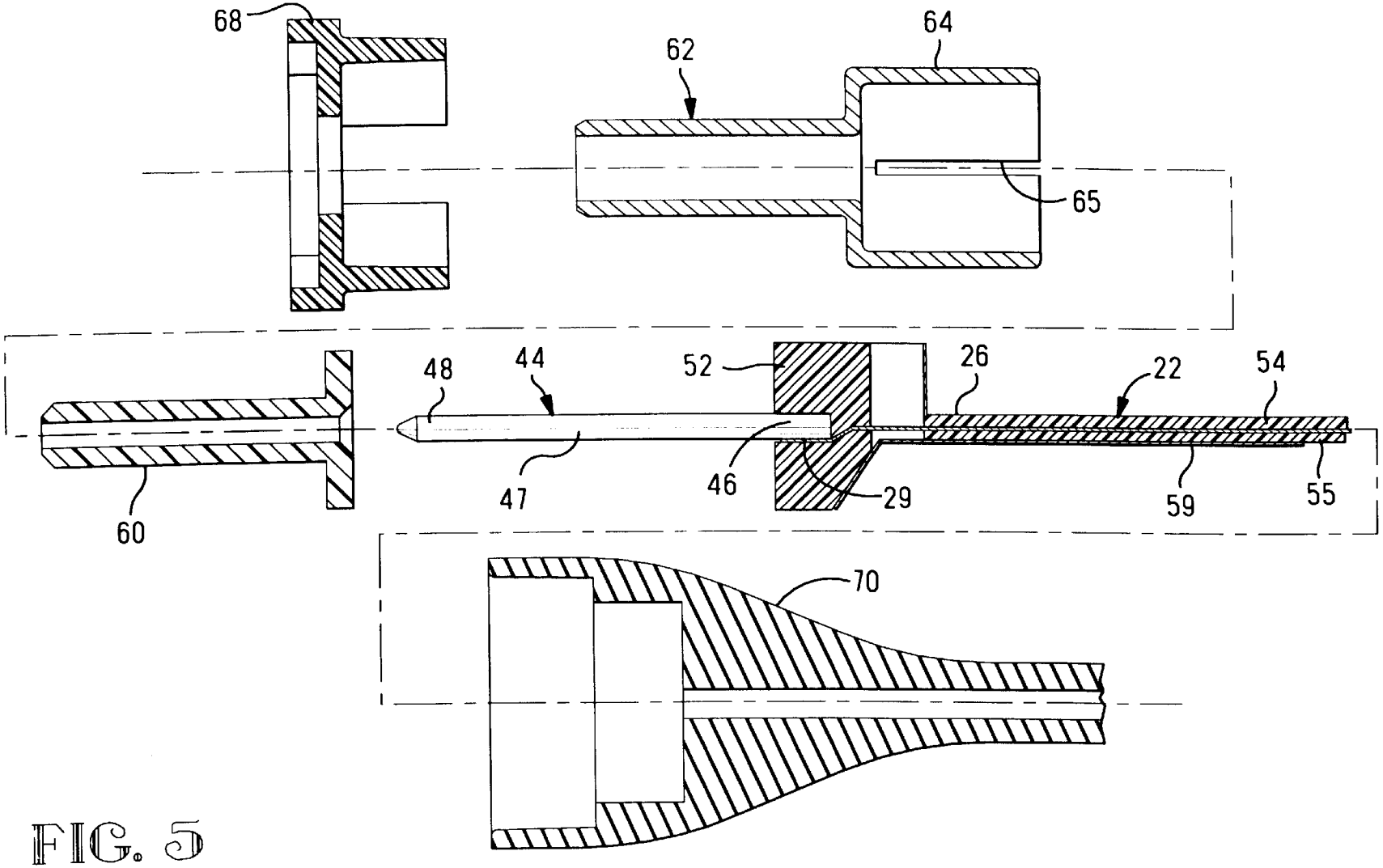
FIG. 5 is an exploded view of the cross-sectional portion of FIG. 4.

Referring now to FIGS. 1 through 6, the antenna assembly 20 of the present invention includes a planar conductor 22 having first and second ends 26, 40, and a coaxial connector assembly secured thereto. The coaxial connector assembly includes an inner contact 44, a dielectric sleeve 60 disposed over the conductor 44, an outer shell 62 having hood portion 64 for establishing electrical connection with ground conductor 59 on the planar conductor 22, an end cap 68, and a outer sleeve or boot 70. As can best be seen in FIGS. 2 through 5, inner conductor 44 includes first and second connecting portions 46, 48, and an intermediate body portion 47 extending therebetween. The first connecting portion 46 is terminated to a conductor 29 at the first end 26 of the planar conductor 22. The dielectric sleeve 60 is disposed around the intermediate body portion 47 of the inner conductor 44 and the outer shell 62 is disposed around sleeve 60. Shell 62 also includes a hood-like portion 64 that extends around ground conductor 59 and the dielectric 52 which encapsulates the end of the planar conductor 22. As best seen in FIGS. 3, 4, and 5, the hood-like portion 64 further includes an inwardly directed tab 66 that engages a ground conductor 59 on the lower surface of the planar conductor 22.

Figure 6:
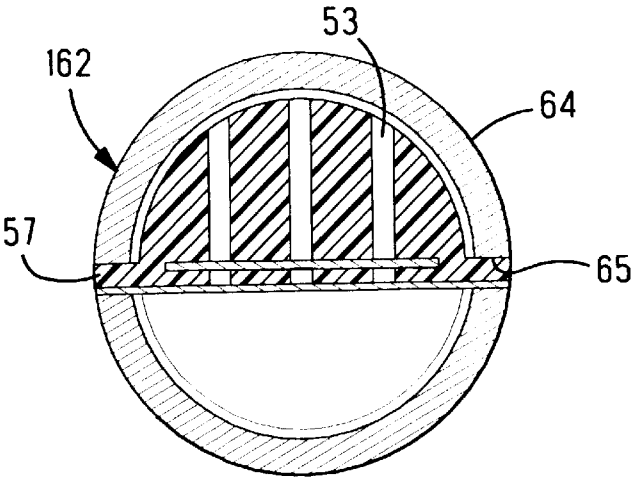
FIG. 6 is a cross-sectional view of an assembly similar to the one shown in FIG. 4 with the outer sleeve removed therefrom and illustrating an alternative mounting of the continuous conductor in the conductive shell.
Figure 2:
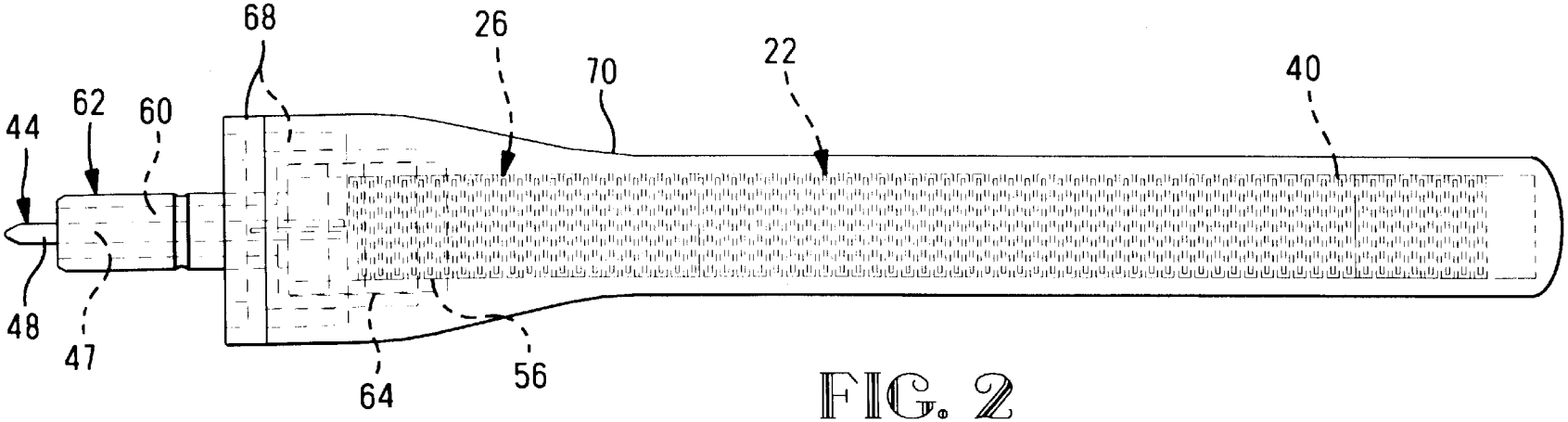
FIG. 2 is a top view of the antenna of FIG. 1 showing the internal structure in phantom.

FIG. 6 is a cross-sectional view of the assembly of FIG. 5 illustrating an alternative embodiment 162 of the conductive shell in which slots 65 formed in the hood section 64 receive tabs 57 and tab portions of the ground conductor 59. The hood 64 may be crimped down on the tabs 57 and soldered to the ground conductor 59 to ensure electrical continuity.

Figure 7:
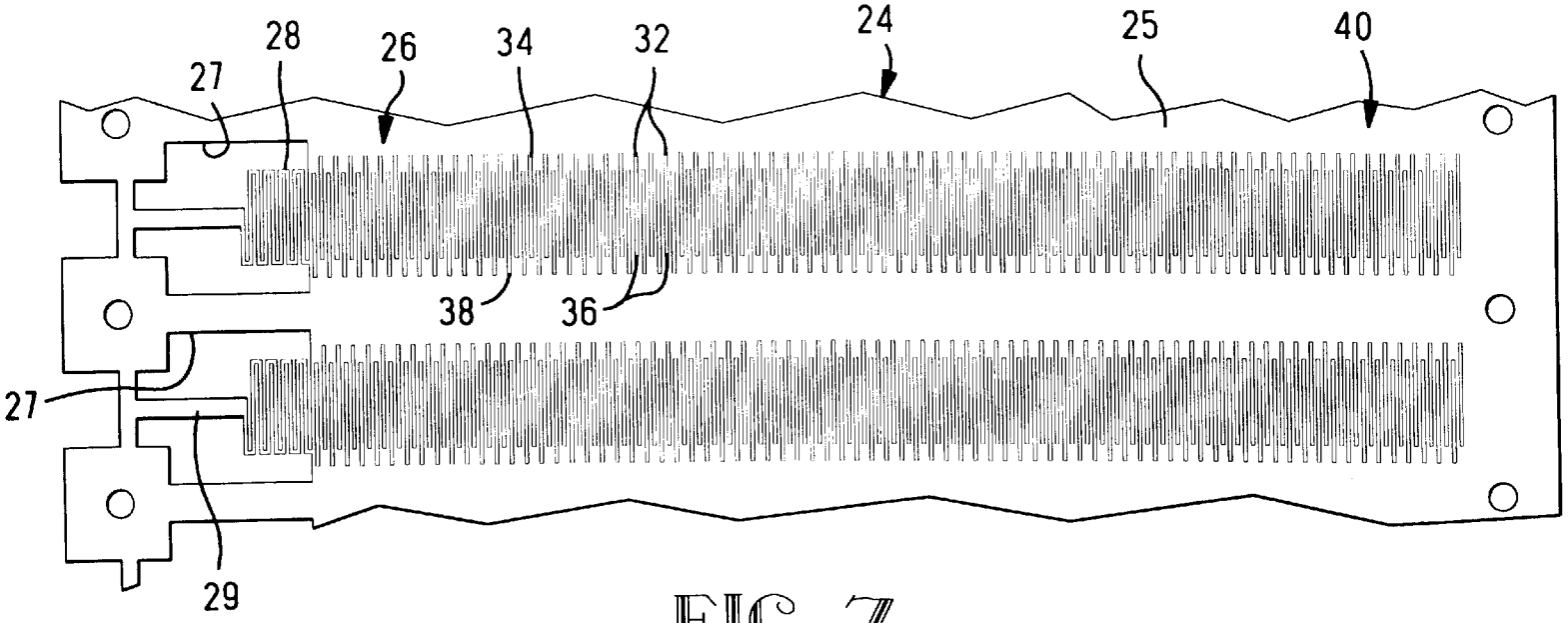
Figure 8:
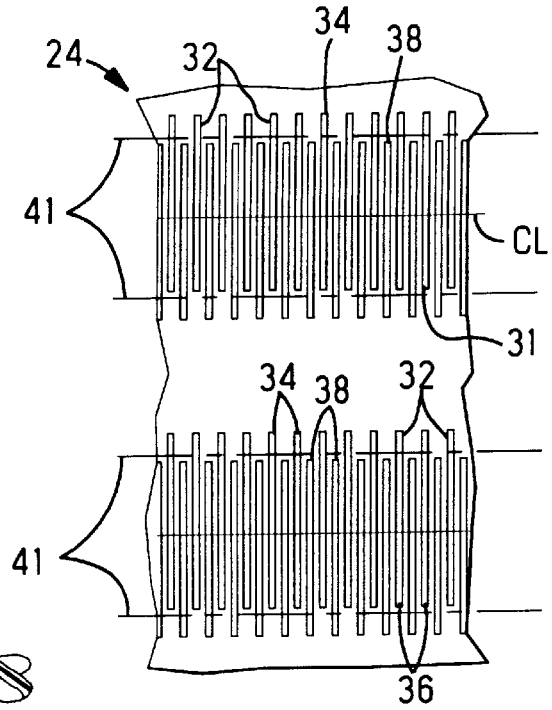
Figure 9:
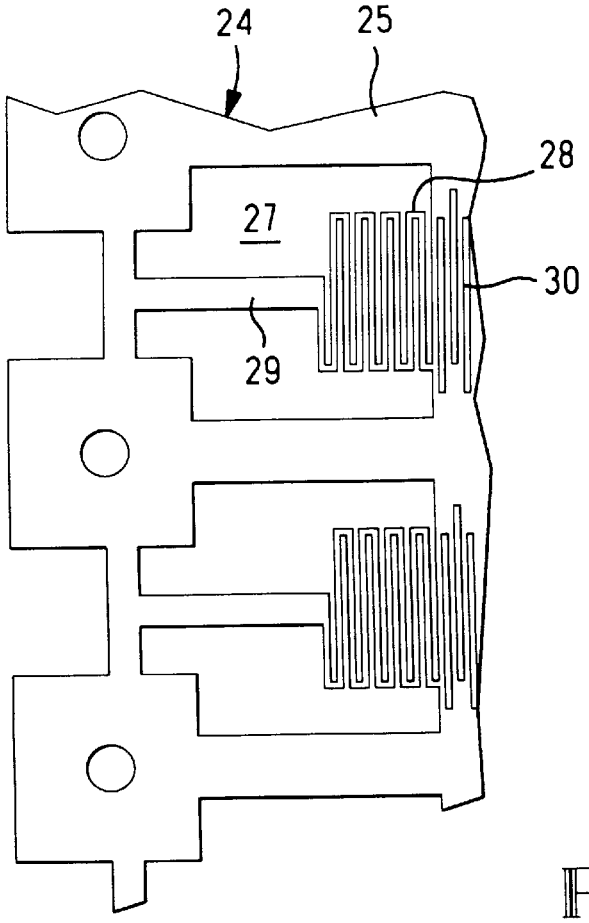

FIGS. 7 through 18 illustrate the manufacturing process for forming the planar conductor in accordance with the present invention. Referring to FIGS. 7, 8, and 9, a metal sheet 24 having opposed major 25 surfaces has a plurality of arrays of slots 30 stamped therein, two of which are shown in FIG. 7. The array of slots 30 have a selected length and are stamped in the continuous sheet 24 of metal such that the ends 34, 38, of adjacent slots 30 are offset from each other by a selected distance in an alternating pattern of long and short slot portions 32, 36, respectively on each side of the center line of the array. Adjacent ones of all of the slots 30 are separated by strips of metal 31 having a selected width. The configuration of the slots 30 is best understood by referring to the enlarged fragmentary portions shown on FIG. 8.

Figure 10:
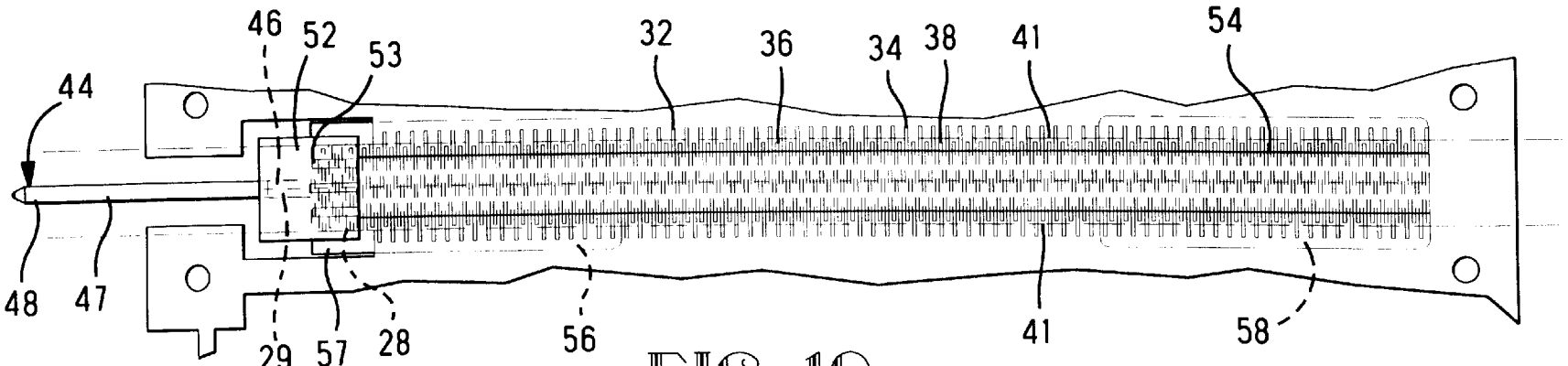
Figure 12:
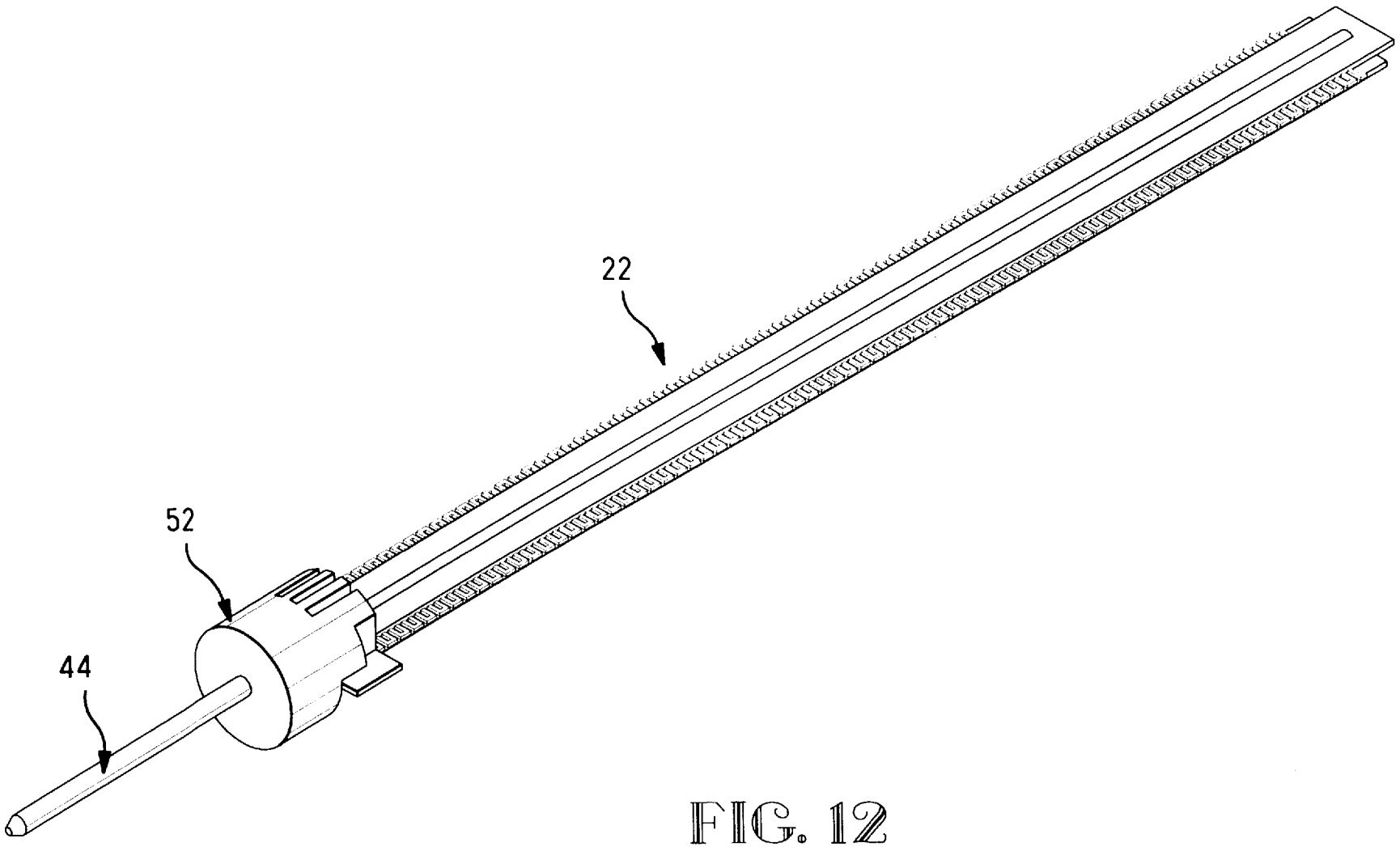
Figure 15:
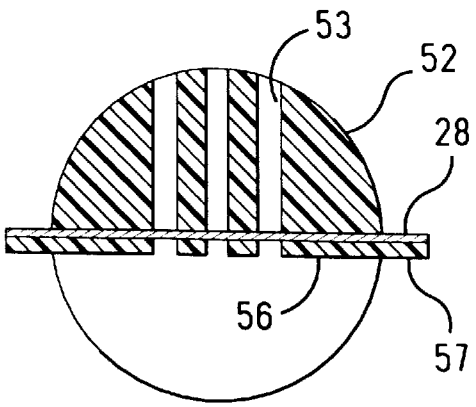
Figure 17:
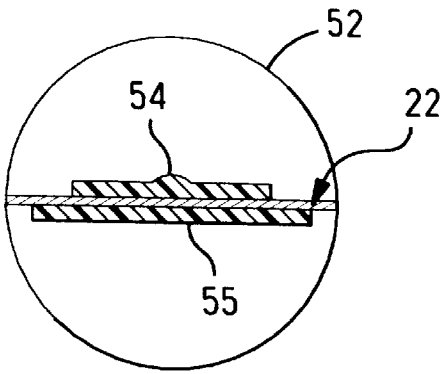

A continuous conductor 28 is stamped at the first end 26 of the arrays of slots 30 with one end of the conductor being in communication with one of the long slot portions 32 and the other end defining a contact pad 29. A portion of the sheet 24 is removed at 27 to define conductor 28 and pad 29, which extends outwardly along the center line of the array, as more clearly seen in FIG. 9. Contact pad 29 is adapted to be electrically and mechanically engaged with a pin contact 44 as best seen in FIGS. 5, 10 and 12. The pin contact 44 having first and second connecting portions 46, 48, and intermediate body 47 is disposed on the conductor 29 such that the first connecting portion 46 may be connected by crimping, solder, or the like to conductor 29.

Figure 14:
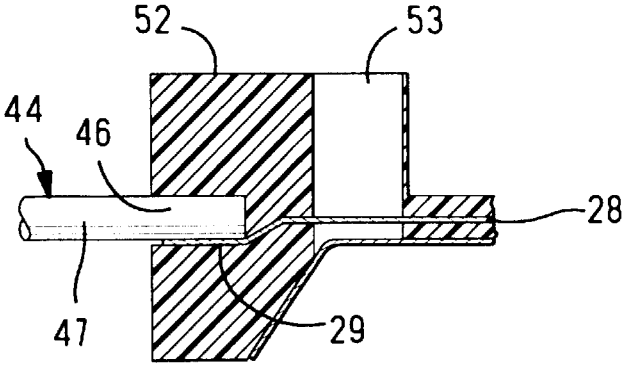
Figure 16:
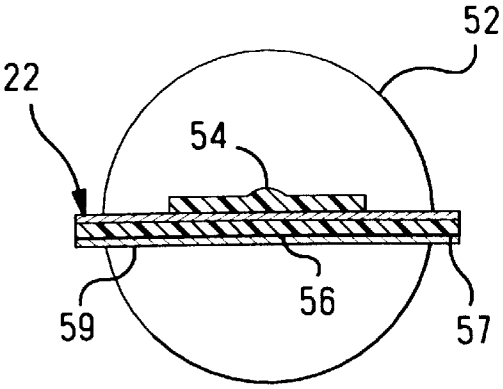

In one preferred method of manufacturing the antenna assembly, each array with portions of the metal sheet 24 attached thereto is placed into a mold and positioned therein in accordance with insert-molding procedures. A dielectric body 52, as best seen in FIGS. 10 and 14, is formed over the continuous conductor 28, the terminated lead 29, and conductor portion 46. The body includes slots 53 that are formed therein as a result of the positioning pins used to hold the continuous conductor 28 and stamped metal sheet 24 in position in the mold during the insert-molding process. The dielectric material is also disposed along the middle portion of the array and along a continuous rib 54 along the center line of at least the top of the array and into each of the slots 30 to fill the respective slot portions 32, 36. A layer of dielectric material also extends along the lower surface of the array and includes a rib 55, as best seen in FIGS. 10, 13, 16, and 17, to provide added support for the planar conductor when it is cut from the metal sheet 24. In one preferred embodiment a portion of the array at the first or lower end 26 and a further portion of the array at the second or upper end 40 also are covered with dielectric material that extends beyond the array of slots as best seen in FIG. 10. As can be seen in FIG. 10, the insulating layer 56 further includes outwardly extending tabs 57 that provide additional support for the ground conductor 59 and are received within slots 65 of the conductive hood 64, as shown in FIG. 6.

Figure 11:
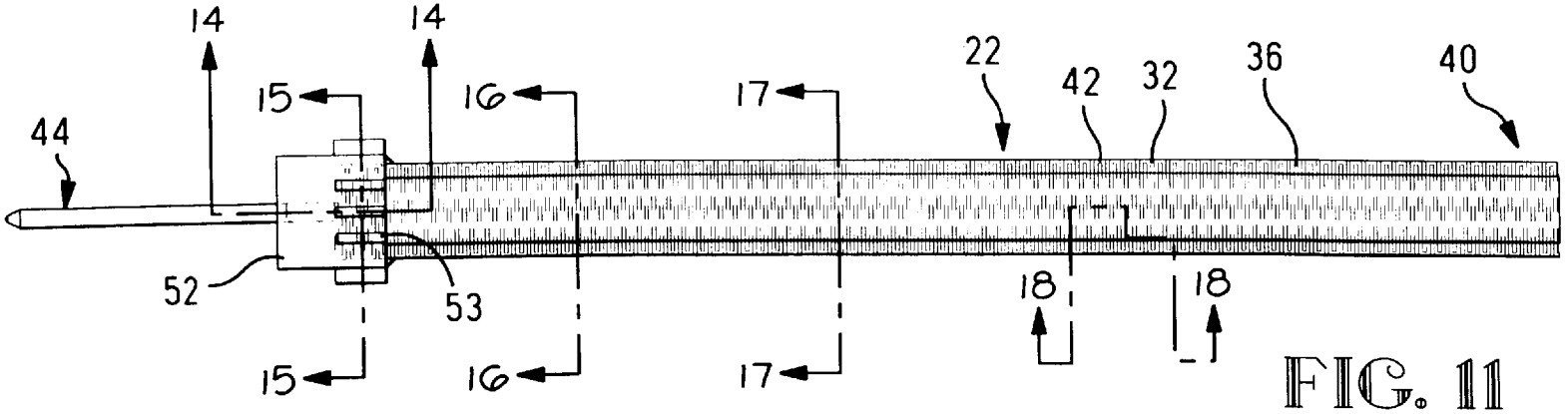
Figure 18:
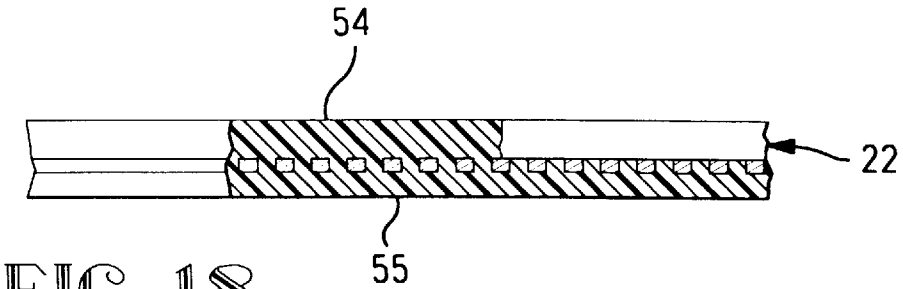
Figure 18:
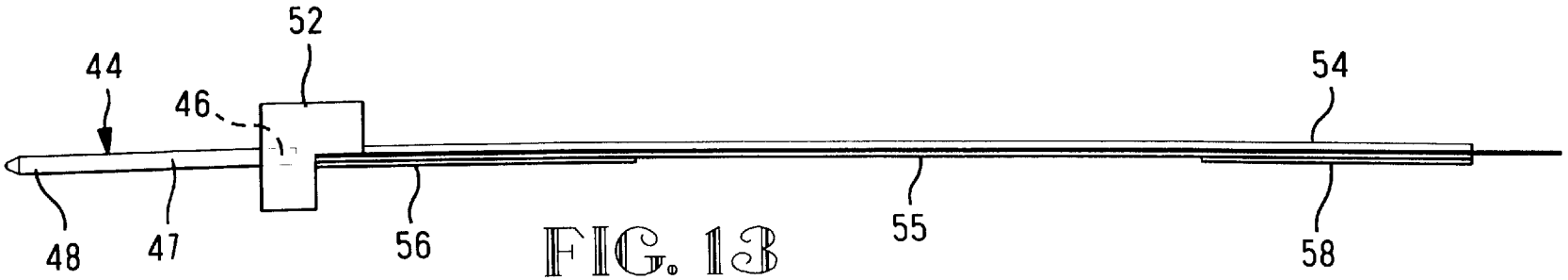

FIG. 11 shows conductor 22 after it has been cut from sheet 24 along each side of the slot-filled strips intersecting each filled long slot portion 32 at a sufficient distance from the ends 38 of the adjacent short slot portions 36 to define strap 42 of metal connecting metal strips on each side of the filled slot 36. The strap 42 preferably is equal in width to the width of the metal strips 31 between adjacent slots 30, as best seen in FIG. 8. Upon severing the structure from sheet 24, a planar conductor is defined having a continuous rectangular wave-like structure extending from the central contact 44 to the second end 40. FIGS. 14 through 18 are sectional views taken through the subassembly of FIG. 11 at various locations therealong.

In the preferred embodiments the planar conductor is stamped from a sheet of copper having a thickness of about 0.006", which achieves the desired strength and flexibility. Other thicknesses also may be used. The selected dielectric material, the distance between adjacent slots, and the length of the array, are preselected to provide the desired electrical characteristics for the antenna. In the preferred embodiments the dielectric material is a methylpentene copolymer available from Mitsui Petrochemicals Limited under the trade name TPX. Other suitable materials may also be used. The thickness of the insulating pads 56, 58, is sufficient to prevent electrical conductivity between a ground conductor disposed on at least pad 56. In the preferred embodiments the ground conductor is a thin adhesive copper foil available from Minnesota Mining and Manufacturing Company. Other conductive tapes may also be used.

Figure 1:
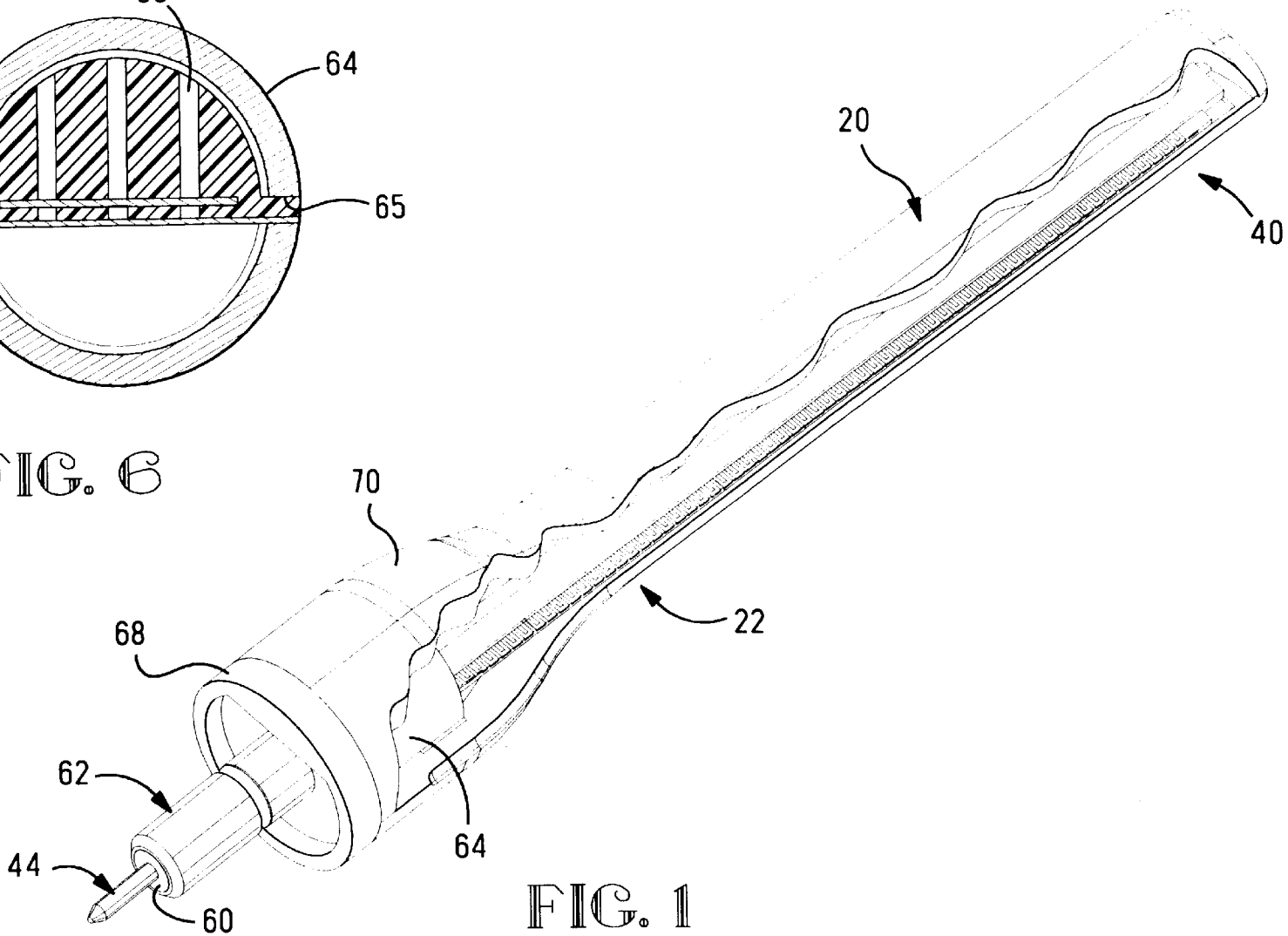
FIG. 1 is a perspective view of the antenna made in accordance with the invention with a portion of the outer sleeve partially cut away.

After the planar conductor 22 has been formed as shown in FIG. 11, a dielectric sleeve 60 is disposed over the intermediate body portion 47 of inner contact 44. The outer conductive sleeve 62 is then disposed around the dielectric sleeve 60 to form the coaxial connection with the contact slots 65 within the hood 64 of conductor sleeve 62 in electrical engagement with corresponding tabs 57 and ground conductor 59 on one side of the planar conductor 22, forming the outer conductor of the coaxial connector as shown in FIG. 1. An end cap 68 seals off the end of the assembly, and a dielectric sleeve or boot 70 is disposed along the entire length to encase the antenna having the planar conductor within insulation. Alternatively, an exterior boot may be overmolded on the end cap and assembly thus eliminating the need to assembly separate pieces.

FIGS. 19 through 26, illustrate an alternative method of manufacturing an electrical article, shown for purposes of illustration as alternative embodiment 120 of the antenna assembly. Antenna embodiment 120 includes a planar conductor 122 having a coaxial connector assembly secured thereto. The coaxial connector assembly includes inner contact 144, a dielectric sleeve 160 disposed over the conductor 144, an outer shell 262, an end cap 168, and a outer sleeve or boot 70. As can best seen in FIGS. 19 through 21, inner conductor 144 includes first and second connecting portions 146, 148 and an intermediate body portion 147 extending therebetween. The first connecting portion 146 is terminated by crimping to a conductor 129 at the first end 126 of the planar conductor 122. The dielectric sleeve 160 is disposed around the intermediate body portion 147 of the inner conductor 144, the first end 126 of insert molded planar conductor 122 and ground conductor 159. The outer shell 162 is disposed around sleeve 160 in the same manner as previously described.

Figure 19:
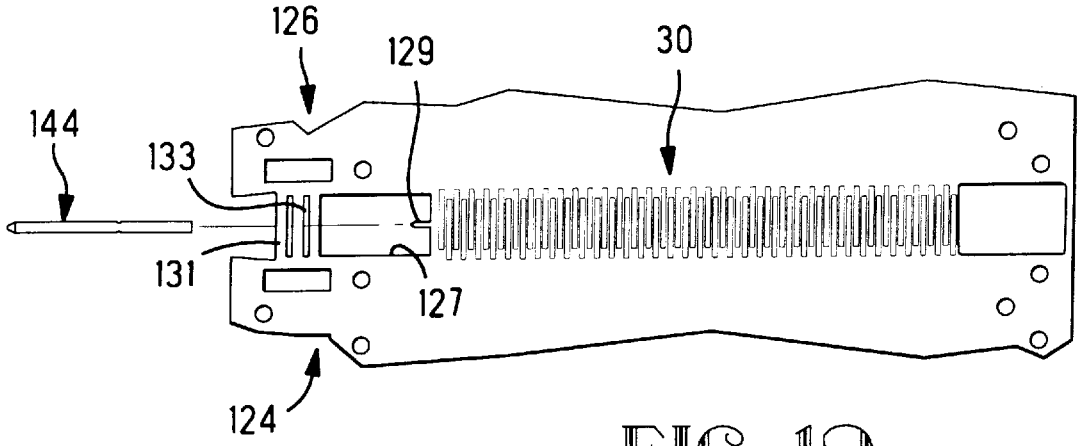
FIGS. 19 through 26 illustrate the steps in making an alternative embodiment of the present invention.
Figure 20:
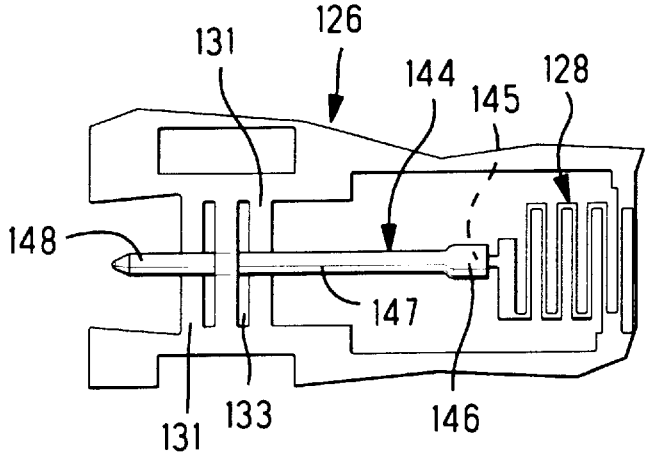

FIGS. 19 through 26 illustrate the manufacturing process for forming the planar conductor in accordance with the second embodiment of the present invention. Referring to FIGS. 19 and 20, which show a fragmentary portion of metal sheet 124 having a lead frame including an array of slots 30, as previously described and having a tab 129 projecting from a first end 126 thereof. The sheet 124 is further stamped with a plurality of straps 131 spaced a selected distance from tab 129, the straps 131 being spaced apart by slots 133 and defining a holding section adapted to hold a discrete second conductive member. In the embodiment shown one of the straps is formed upwardly and two are formed downwardly to receive a pin terminal 144, as shown.

Figure 21:
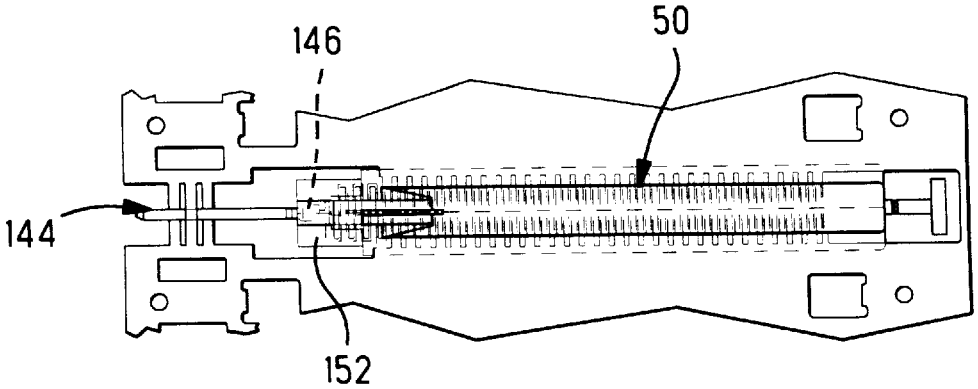

A continuous conductor 128 is stamped at the first end 126 of the arrays of slots 30 with one end of the conductor being in communication with one of the long slot portions 32 with the other end defining tab or conductive lead 129. Tab 129 is adapted to be electrically and mechanically engaged with a discrete second conductive member shown as a pin contact 144 as best seen in FIGS. 19, 20, and 21. A portion of the sheet 124 is removed at 127 to define conductor 128 and tab or lead 129, which extends outwardly along the center line of the array. In the preferred embodiment, pin contact 144 includes a bore 145 extending at least partially into first connecting portion 146 and adapted to receive tab 129 therein and be crimped thereto. The intermediate contact portion 147 is interwoven through slots 133, which hold the pin contact 144 securely in alignment with the array during the overmolding process. The lead frame with the discrete second conductive member terminated thereto defines a subassembly. It is to be understood that the second conductive member may be terminated to the contact section by crimping, soldering or other techniques as known in the art.

Figure 22:
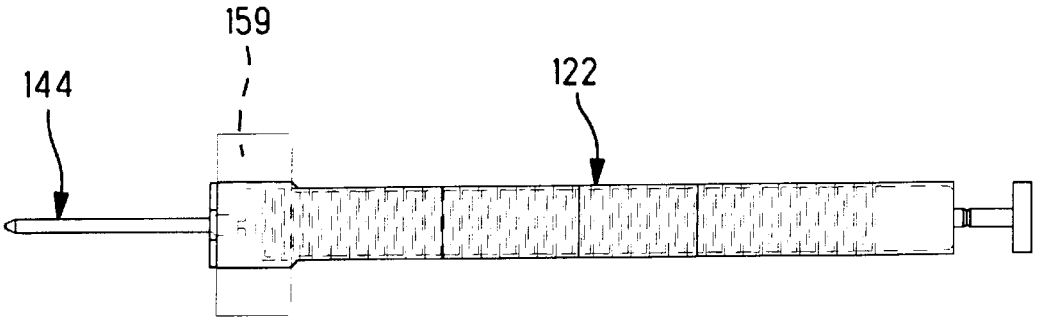

A dielectric body 152 as best seen in FIGS. 21 and 22 is formed over the subassembly at preselected areas thereof including, inter alia, continuous conductor 128, the terminated tab 129, and conductor portion 146. The dielectric material is also disposed along the array and the overmolded array is severed from sheet 124 in the same manner as previously described. FIG. 22 illustrates the placement of a ground conductor foil 159 that is then wrapped around dielectric body 152.

Figure 25:
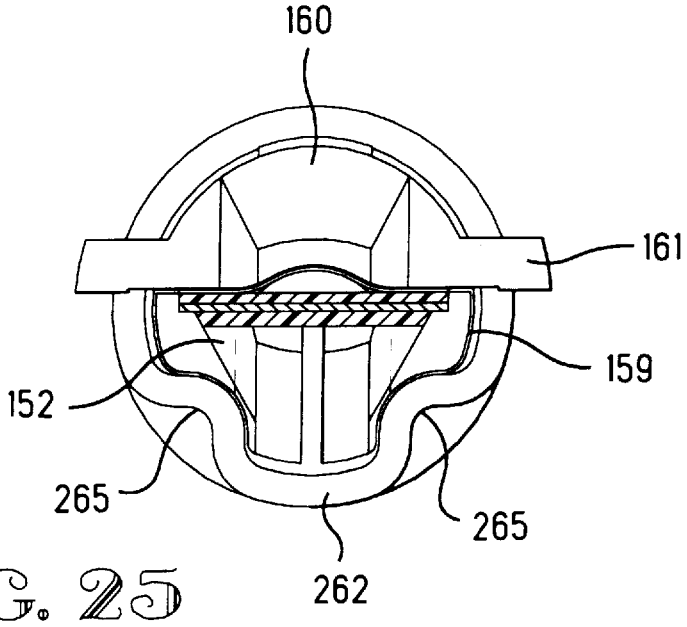

Dielectric sleeve 160 is disposed over the intermediate body portion 147 of inner contact 144, first end 126 of insert molded conductor 122 and ground conductor 159. The outer conductive sleeve 262 is then disposed around the dielectric sleeve 160 to form the coaxial connection with the ground conductor 159 within hood 264 of conductor sleeve 262 and in electrical engagement therewith. In this embodiment, hood 264 is then crimped to conductor 159 as best seen in FIG. 25. The crimp serves to make electrical contact between shell 262 and ground conductor 159 and also to mechanically secure the assembled components.

Figure 23:
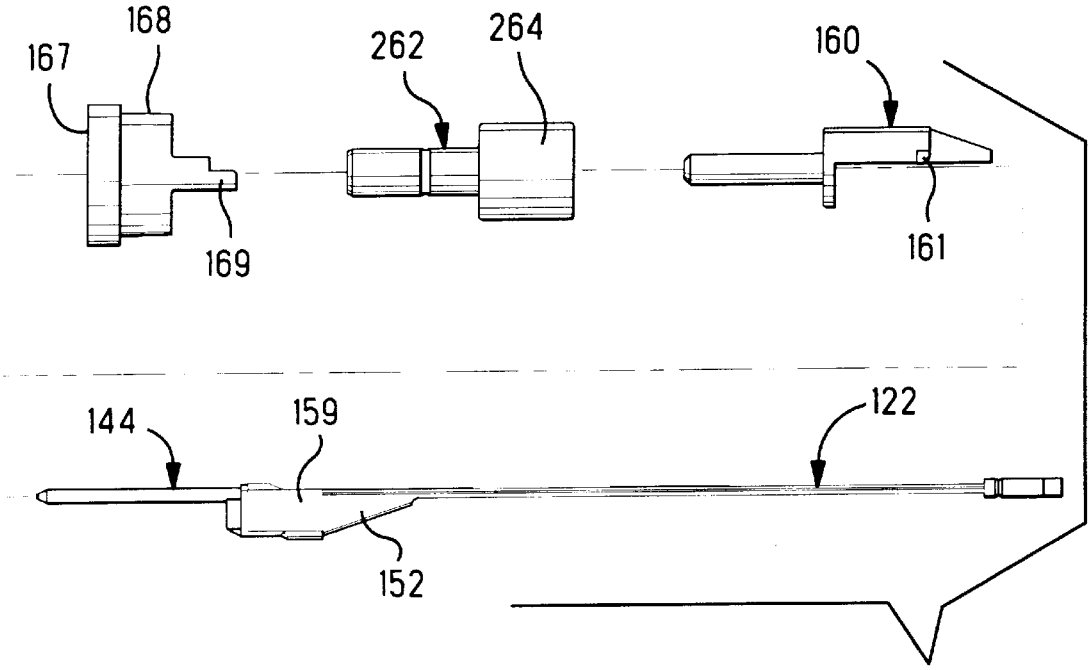
Figure 24:
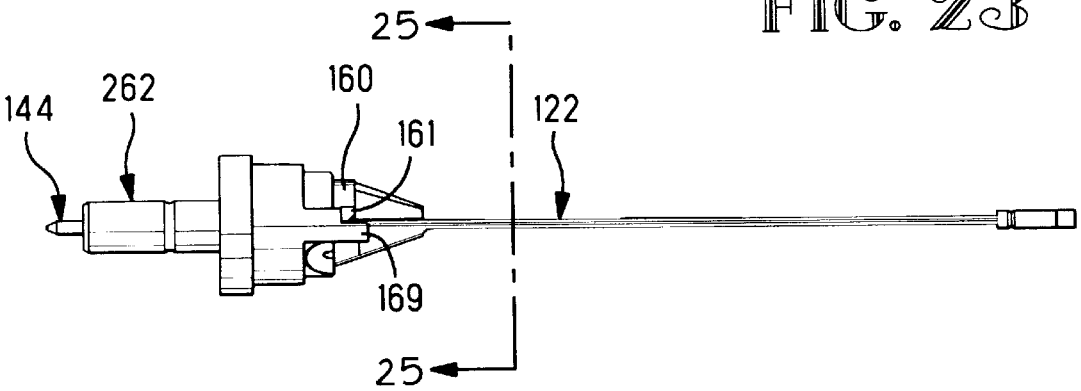
Figure 26:
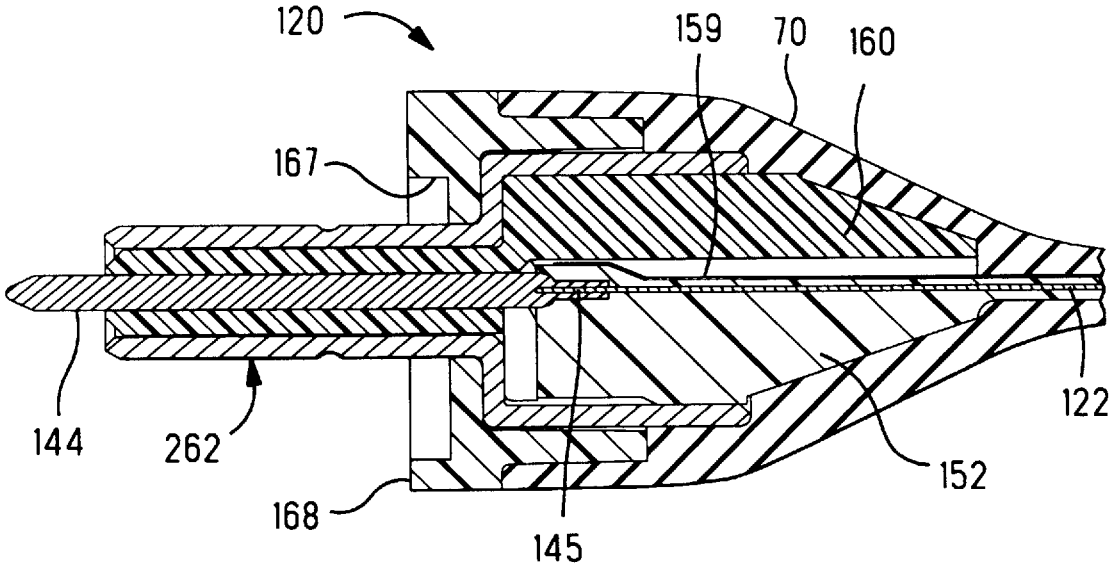

End cap 168 is used to seal the end of the assembly. When the assembly is to be used as an antenna, it is desirable that the antenna be aligned in a particular orientation with respect to the electric device to which the antenna is being attached. In the preferred embodiment of the present invention, forward surface of end cap includes a polarizing surface 167, as seen in FIG. 26. End cap 168 further includes L-shaped projections 169 extending rearwardly therefrom and located asymmetrically with respect to the center line of the cap. The L-shaped end cap projections 169 are disposed to engage outwardly extending tabs 161 of dielectric sleeve 160, as shown in FIGS. 23 and 25, to assure end cap 168 is properly located on the assembly. A dielectric sleeve or boot 70 may be molded over or disposed along the entire length of the assembly, as previously described.

The present invention provides a cost effective method for manufacturing the antenna because multiple planar conductor structures can be molded simultaneously depending upon the size of the mold and the structure of the stamped metal is relatively easy to handle since the planar rectangular wave-like structure is not cut from the entire sheet of metal until after molding has taken place. The inner contact can be soldered or crimped to the conductor lead in accordance with the embodiments described herewithin. It is to be understood that other methods of interconnecting the contact to the conductor also may be used. It is also to be understood that the dielectric body 52, 152, which is molded over the first end 26, 126, of the antenna, also may be extended over the central body portion of the contact 44, 146, to provide an insulating layer thereby eliminating the separate sleeve. It is to be understood that the planar conductor may be formed separately and the structure then crimped to an already existing coaxial contact. It is to be further understood that while the embodiment shown is a monopole antenna, the invention may be used to make dipole antennas and other electrical articles, as known in the art.

It is thought that the planar conductor and the flexible antenna of the present invention and many of the attendant advantages will be understood from the foregoing description. It is apparent that various changes may be made in form, construction, and arrangement of parts thereof without departing from the spirit or scope of the invention, or sacrificing all of its material advantages.

We claim:

1. A flexible antenna comprising:

a planar conductor stamped from a metal sheet and having a contact section at one end thereof and a plurality of substantially parallel metal strips, each successive strip being connected at one end to an adjacent previous strip and at the other end to the next strip by a metal strap to define a continuous conductor;

a contact lead electrically and mechanically secured to said contact section defining a termination;

dielectric material molded over selected areas of said conductor including over and between said strips and said termination defining selected insulated areas and an insulated termination, at least one of said selected insulated areas defining an insulating pad adapted to receive a ground conductor;

said ground conductor being disposed on said at least one insulating pad; and a conductive shell disposed over said insulated termination of said planar conductor, said shell being in electrical engagement with said ground conductor, said lead, insulation and shell defining a coaxial connector.

2. The flexible antenna of claim 1 further including a resilient sleeve-like member disposed over said conductor and said conductive shell.

3. The flexible antenna of claim 1 wherein said contact lead is part of an electrical contact, said antenna further including a discrete dielectric sleeve disposed over said contact lead and an adjacent portion of said contact, said sleeve being dimensioned to be received inside said conductive shell.

4. The flexible antenna of claim 1 wherein said lead is electrically and mechanically secured to said contact section by soldering.

5. The flexible antenna of claim 1 wherein said lead is electrically and mechanically secured to said contact section by crimping.

6. The flexible antenna of claim 1 wherein said contact lead includes a bore extending axially into said lead from a forward end thereof, said bore being dimensioned to receive said contact section of said planar conductor.

7. The flexible antenna of claim 5 wherein said lead is electrically and mechanically secured to said contact section by crimping.

* * * * *